United States Patent [19]

Trubin et al.

[11] 4,114,658

[45] Sep. 19, 1978

[54] MECHANISM FOR COMPENSATING THE LENGTH OF A WEFT THREAD FOR A LOOM

[76] Inventors: Vladimir Fomich Trubin, ulitsa Entuziastov, 5/1, kv. 28; Alexei Alexandrovich Redin, ulitsa Egerskaya, 25, kv. 42, both of Cheboxary, U.S.S.R.

[21] Appl. No.: 768,493

[22] Filed: Feb. 14, 1977

[30] Foreign Application Priority Data

Mar. 1, 1976 [SU] U.S.S.R. ..... 2329877

[51] Int. Cl.[2] ..... D03D 47/34

[52] U.S. Cl. ..... 139/452

[58] Field of Search ..... 139/429, 450, 452; 66/125

[56] References Cited

U.S. PATENT DOCUMENTS

| | | | |
|---|---|---|---|
| 3,444,900 | 5/1969 | Schaffer | 139/452 |
| 3,587,664 | 6/1971 | Mullekom | 139/452 |
| 3,732,896 | 5/1973 | Jekl et al. | 139/452 |

*Primary Examiner*—Henry S. Jaudon

*Attorney, Agent, or Firm*—Steinberg & Blake

[57] ABSTRACT

A mechanism for compensating the length of a weft thread comprises a movable apparatus for forming a loop from the weft thread located between thread-guides, and a device for retaining the loop of the weft thread, made as a stationary plate-type grip. This makes it possible to propel the weft thread without placing the latter under additional tension and thereby to reduce the breakage rate of the weft thread. Besides, this enables the mechanism to be employed on stationary weft supply looms for producing multicolor-weft cloths.

4 Claims, 4 Drawing Figures

MECHANISM FOR COMPENSATING THE LENGTH OF A WEFT THREAD FOR A LOOM

The present invention relates to looms wherein a weft thread gripped by a shuttle is inserted through the shed while being withdrawn from a bobbin situated outside of the shed, and, more particularly, it relates to a mechanism for compensating the length of a weft thread for these looms. The invention can be advantageously used on looms for producing multicolour-weft cloths.

At present, there are known mechanisms for compensating the length of a weft thread on looms comprising a movable apparatus for forming a loop from the weft thread located between threadguides, and a device for fixing the loop of the weft thread.

In these mechanisms, the apparatus for forming the loop from the weft thread and the device for fixing the loop may be of various designs. For example, in French Pat. No. 1,260,397, the movable apparatus for forming the loop functions also as the device for fixing and releasing the loop. This apparatus is essentially a lever associated through the medium of a cam to the main shaft of the loom and carries a threadguide at the end. This apparatus forms and releases the loop at a rate which depends on the rotational speed of the loom main shaft.

Since the speed of the weft thread carrier on the loom is not governed by the rotational speed of the loom main shaft, whereas the speed of releasing of the loop of the weft thread by the movable apparatus depends on the rotational speed of the main shaft of the loom, there always exists a discrepancy between the speeds of propulsion and releasing of the loop of the weft thread. Therefore if the weft thread propulsion speed exceeds the speed of releasing of the loop, an additional load is imposed on the weft thread due to its bending between the threadguides.

If the speed of releasing of the loop is higher than that of the weft thread carrier, particularly when the movable apparatus starts moving in an opposite direction, a saddle-like sagging of the loop of the weft thread occurs, rendering the latter twisted. As a result, the breakage rate of the weft thread increases, while the production rate of the loom decreases. Moreover, the mechanism for compensating the length of the weft thread of such a design is intended for operation only with one weft thread, therefore, for weaving a multicolour-weft cloth on the loom, the number of movable apparatus must correspond to the number of the weft threads successively propel through the shed which makes the structure of the pattern mechanism on these looms more complex. The need to alternatively control the movable apparatus entails additional loads on the change-over element of the pattern mechanism, which causes premature wear-out of its component parts and shortens the service life of the loom.

In a mechanism for compensating the length of the weft thread, employed on a stationary weft supply loom for producing multicolour-weft cloths, the movable apparatus is made as a forked lever embracing the guiding grate and geared to the main shaft of the loom, whereas the device for holding the loop of the weft thread is made as a movable closed frame or sector used to hold the threads and to deliver one of them to the zone of action of the weft thread carriers.

Such a structure of the mechanism for compensating the length of the weft thread permits simplifying the pattern mechanism, but from the moment when the releasing of the loop of the weft thread begins, with the reverse motion of the movable apparatus initiated, up to the moment when the weft thread carrier starts moving, the thread loop remains in a free state and is liable to get twisted. With the propulsion of the weft thread through the loom shed under way and with the propulsion speed exceeding the speed of motion of the movable apparatus, the twisted loop overtakes the apparatus coming in contact with the surface of the forked lever, whereby the tension applied to the weft thread grows abruptly.

In case the movable apparatus starts its reverse motion and the weft thread carrier starts it flight simultaneously, the weft thread, while being in contact with the surface of the forked lever during propulsion, undergoes additional tension depending on the angle of lap thereof and on the difference between the speeds of movement of the lever and the carrier, which also increases the breakage rate of the weft thread. In the described mechanism, with the loop of the weft thread retained by the frame or sector, the forked lever controlling one and the same thread during several cycles of formation of the cloth element tosses up the weft threads not participating in operation. This lessens the tension applied to these threads in the zone of delivery thereof to the carrier which, later on, results in that the delivery of the weft thread to the carrier is disturbed and the thread is missed during propulsion through the shed, whereby the production rate of the loom is reduced.

Changing-over of the movable frame in the course of changing the weft colour causes additional loads on the changeover device, which leads to premature wear-out of the device and shortens the service life of the loom.

It is an object of the present invention to obviate the above disadvantages.

The principal object of the present invention is to provide a mechanism for compensating the length of a weft thread for a stationary weft supply loom, wherein the device for direction shown by arrow A, comes into contact with the thread 5, tension applied to the weft thread during propulsion thereof through the shed and its reliable holding thereby, making it possible to appreciably reduce the breakage rate of the weft thread and to increase the production rate of the loom.

These and other objects are attained in a mechanism for compensating the length of a weft thread for a travelling-wave loom, comprising a movable apparatus for forming a loop from the weft thread located between threadguides, and a device for releasably retaining the loop of the weft thread, in which mechanism, in accordance with the present invention, the device for releasably retaining the loop of the weft thread is made as a stationary plate-type grip.

Such a structure of the device for releasably retaining the loop of the weft thread enables the movable apparatus forming the loop to finish the reverse motion before the propulsion of the weft thread through the shed of the warp is started, which creates conditions for propulsing the weft thread without the latter coming in contact with the surface of the movable apparatus, whereby the tension applied to the propulsed thread is lessened and, consequently, the breakage rate thereof is reduced, which contributes to a higher production rate of the loom.

According to an alternative embodiment of the apparatus, the plate-type grip is formed by two plates elastically tightened together.

According to another embodiment of the apparatus, the plate-type grip is formed by two plates one of which is elastically urged against the other.

Such embodiments of the plate-type grip provide for releasably retaining of the loop of the weft thread at a constant tension applied to the thread, which secures the reliability of delivery thereof to the carrier. The loop of the weft thread in this mechanism is withdrawn from the retaining means by the weft thread carrier itself, due to which the structure of the pattern mechanism and that of the mechanism for compensating the length of the weft thread are simplied.

The plate-type grip preferably has a converging configuration on the side of entrance of the weft thread, which renders the introduction of the weft thread into the plate-type grip more reliable.

When employing the proposed mechanism in looms for weaving multicolour cloths or using low-count weft, the device for releasably retaining the loop of the weft thread is preferably made up of a plurality of stationary plate-type grips.

It can be seen that the herein-disclosed mechanism for compensating the length of the weft thread, as compared with the prior art, permit propelling the weft thread without placing the latter under additional tension, thereby decreasing the breakage rate of the weft thread and increasing the loom production rate.

Since the loop of the weft thread is withdrawn by the weft thread carrier, the mechanism for compensating the length of the weft thread requires no change-over elements which simplifies its construction, improves the reliability of operation and prolongs the service life of the loom.

Given below is a detailed description of the present invention with reference to the accompanying drawings, wherein.

Figure 2:
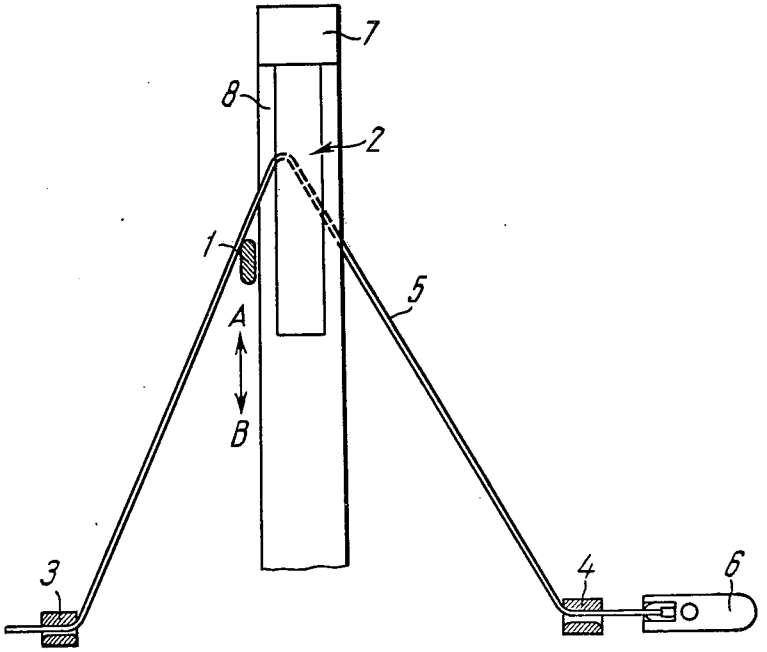
FIG. 2 is a front view of the mechanism of FIG. 1.

The mechanism for compensating the length of the weft thread is installed on a loom (not shown--) on the side of entrance of the weft thread carriers and includes a movable apparatus 1 (FIGS. 1 and 2) for forming a loop from the weft thread, and a means for releasably retaining the loop of the weft thread, made as a stationary installed plate-type grip 2. As is apparent from FIGS. 2 and 4, the movable means 1 forms from the weft thread 5 a loop which has a substantially inverted V-shaped configuration.

The apparatus 1 (FIG. 1) for forming the loop is made as a horizontally extending movable bar or strip geared in any known manner to the main shaft of the loom for this strip to reciprocate in a vertical plane, in the direction shown by arrows A and B. Therewith, this apparatus 1 is installed between threadguides 3 and 4 (FIG. 2) at a right angle to a weft thread 5 whose end is gripped in a carrier or shuttle 6 of the loom. Thus, the weft thread 5 initially extends along a straight line through the space defined between the thread guides 3 and 4, and the bar 1 moves upwardly, as viewed in FIGS. 2 and 4, to engage and displace the thread 5 upwardly, extending the thread upwardly from the guides 3 and 4, along a predetermined path where at least one grip 2 is situated so as to introduce the thus-formed loop into at least one grip 2.

The plate-type grip 2 (FIG. 1) is mounted on a bracket 7 secured in a support 8, the latter being attached either to the loom framework or to any part thereof convenient for installation of this mechanism.

The plate-type grip 2 is composed of two plates 9 and 10 (FIG. 3) elastically urged against each other. Tightening of the plates 9 and 10 together may be attained in any way, for instance, the plates 9 and 10 may be simply blade springs.

Figure 1:
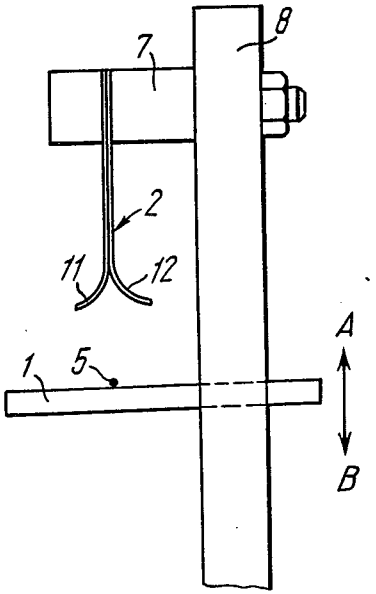
FIG. 1 shows schematically a mechanism for compensating the length of a weft thread.

In accordance with the embodiment of the plate-type grip, shown in FIG. 1, it is formed by two plates 11 and 12, the plate 12 being elastically urged against the plate 11 and made from the blade spring.

The construction of the plate-type grip is by no means restricted to the herein described embodiments because used as such a grip may be any device wherein parts forming this grip have a large area of contact with each other or contact each other along a line.

The plate-type grip 2 is of a converging configuration on the side of entrance of the loop. This converging configuration is formed by free ends of the plates 9 and 10 or 11 and 12 which are bent outward as is shown in FIGS. 1 and 3.

Figure 4:
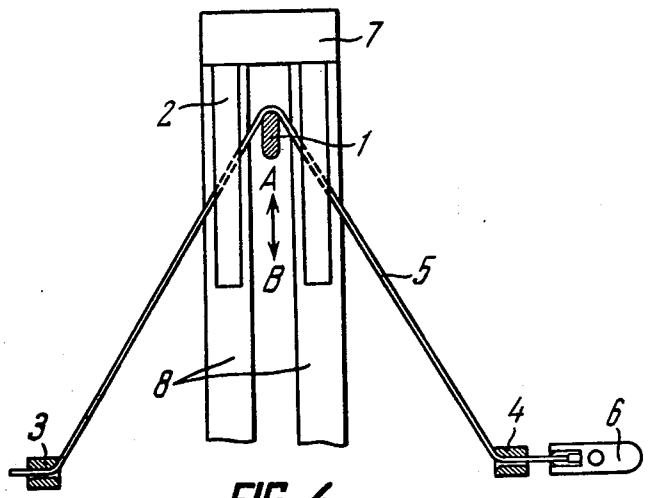
FIG. 4 is a front view of another embodiment of the mechanism.
Figure 3:
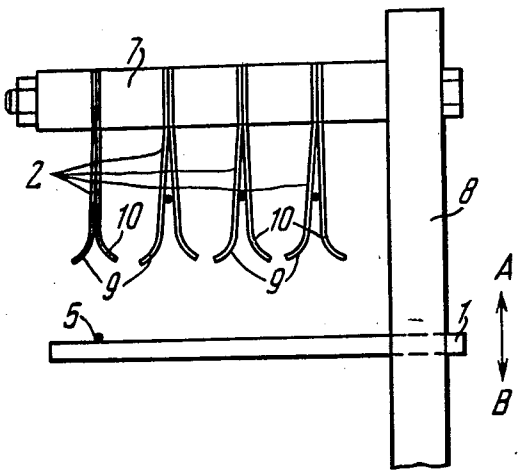
FIG. 3 shows an alternative embodiment of the mechanism according to the invention.

According to the embodiment shown in FIG. 3, the means for releasably retaining the loop of the weft thread is made up of a plurality of stationary plate-type grips 2. These grips 2 are arranged either in one row as is shown in FIG. 3 or in two rows as is shown in FIG. 4, the strip or bar 1 moving between the rows of grips as is shown in FIG. 4.

The mechanism for compensating the length of the weft thread operates as follows. After the weft thread 5 (FIGS. 1 and 2) has been gripped by the shuttle 6 which travels to the entrance side of the shed, with the thread 5 initially extending along a straight line across the space between the thread guides 3 and 4, the movable strip 1, while moving upward in the direction shown by arrow A, comes in contact with the thread 5, forms a loop of substantially inverted V-shaped configuration therefrom and at the end of the upward motion places it between the plates 9 and 10 (FIG. 3) or 11 and 12 (FIG. 1) of the plate-type grip 2. The thread 5 is inserted between two plates elastically tightened together, held by them, after which the strip starts moving downward in the direction of arrow B, i.e., starts its reverse motion and stops moving before the weft thread is propelled by the carriers 6. The weft thread 5 at the beginning of travel through the shed is pulled from the plate-type grip 2 by the carrier 6 and subsequently, while travelling through the shed, the thread 5 runs through the threadguides 3 and 4 without coming in contact with the surface of the movable strip because the latter is now in the lowermost position.

What is claimed is:

1. A mechanism for compensating the length of a weft thread for a stationary weft supply loom, comprising: a pair of thread guides fo guiding a weft thread which is about to be introduced into a shed, said thread guides defining between themselves a space along which a weft thread initially extends along a substantially straight line; a movable means movable across said straight line through and beyond said space for engaging a weft thread guided by said thread guides and extending the weft thread from said guides while displacing the weft thread along a predetermined path and forming a loop from the weft thread; and a releasable gripping means situated along said path for receiving said loop and for releasably retaining the formed loop of the weft thread, said releasable gripping means including at least one stationary plate-type grip of a converging configuration at an end provided for entrance of the loop of weft thread.

2. A mechanism as claimed in claim 1, wherein the plate-type grip is formed by two plates elastically tightened together.

3. A mechanism as claimed in claim 1, wherein the plate-type grip is formed by two plates one of which is elastically urged against the other.

4. A mechanism as claimed in claim 1, wherein said releasable retaining means includes a plurality of stationary plate-type grips.

* * * * *